US005867939A

United States Patent [19]

Merrill

[11] Patent Number: 5,867,939

[45] Date of Patent: Feb. 9, 1999

[54] AUTOMATIC GATE OPENING DEVICE

[76] Inventor: Charles T. Merrill, 228 Yucca Trail, Beeville, Tex. 78102

[21] Appl. No.: 942,951

[22] Filed: Oct. 2, 1997

[51] Int. Cl.[6] ..... E05F 11/24

[52] U.S. Cl. ..... 49/340; 49/346; 49/25; 49/139

[58] Field of Search ..... 49/346, 340, 339, 49/25, 139, 386, 331, 333, 334, 338, 246, 250

[56] References Cited

U.S. PATENT DOCUMENTS

| | | | |
|---|---|---|---|
| 1,175,985 | 3/1916 | Phelps | 49/331 |
| 2,592,891 | 4/1952 | Hall | 49/139 X |
| 3,353,300 | 11/1967 | Wray | 49/386 |
| 3,500,585 | 3/1970 | Vollmar | 49/340 X |
| 4,330,958 | 5/1982 | Richmond | 49/340 X |
| 4,903,435 | 2/1990 | Bittmann et al. | 49/340 |

*Primary Examiner*—Jerry Redman

[57] ABSTRACT

The present invention relates to a gate closing device which operates either in an automatic mode or a manual mode. The device includes a first track which is adapted to be secured to a gate, and a second track to which a driving motor is interconnected. A linkage is slidably interconnected to both of these tracks. Activation of the motor results in the movement of the linkage, and thus the opening or closing of the gate. A damping device is employed at the first end of the linkage. The damping device enables the gate to be opened a slight distance without activating the motor.

5 Claims, 4 Drawing Sheets

FIG 3
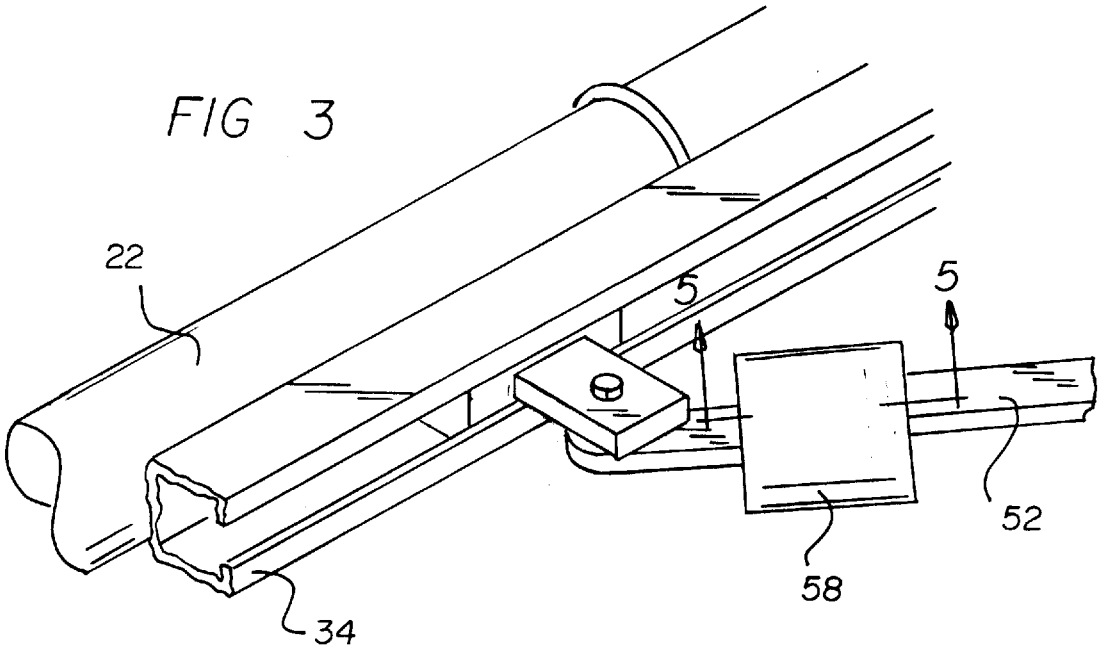
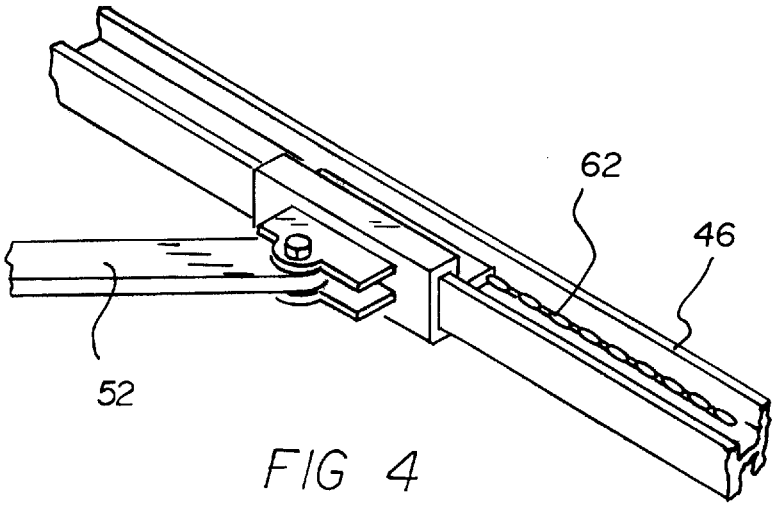
FIG 4

FIG 5
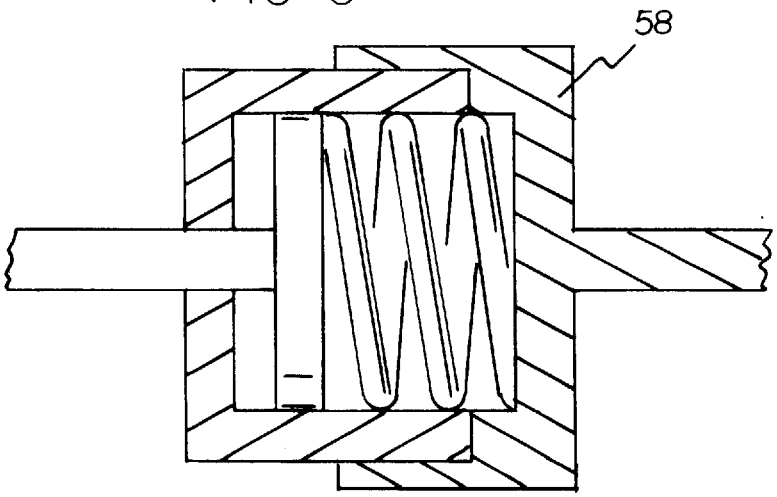
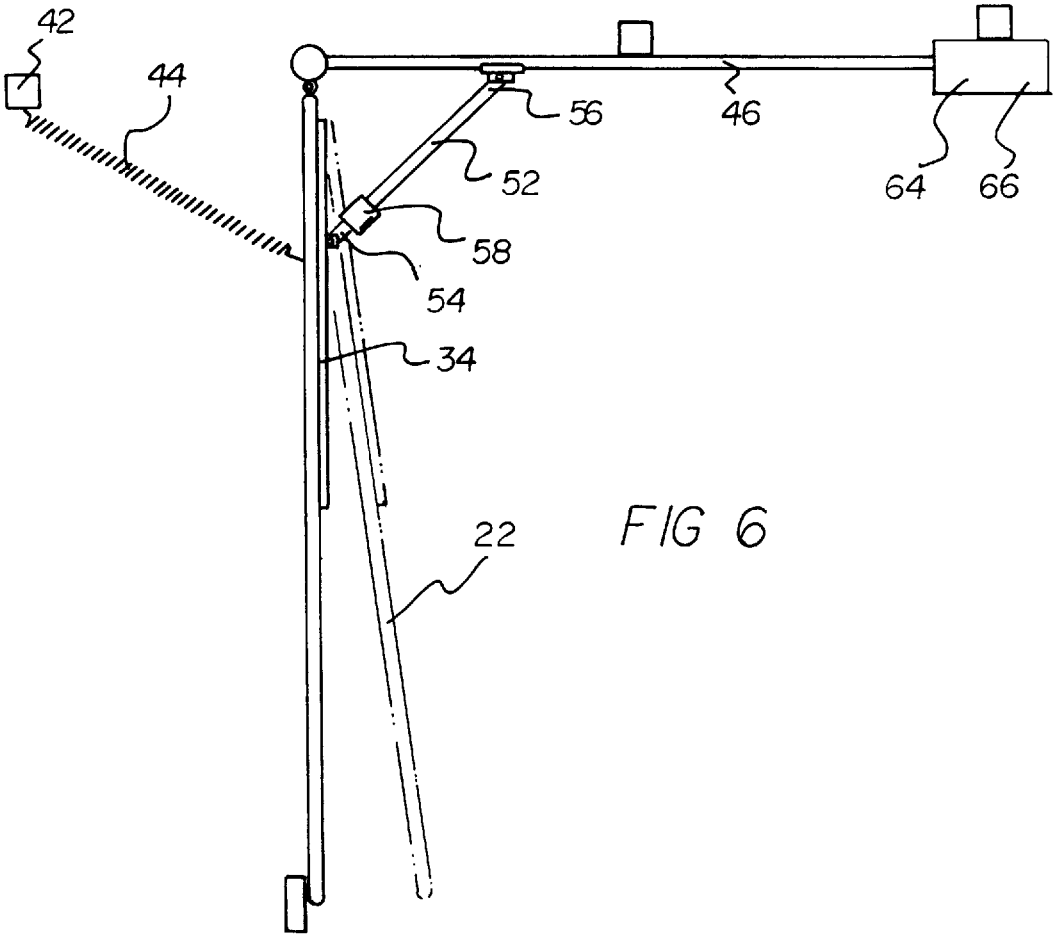
FIG 6

AUTOMATIC GATE OPENING DEVICE

BACKGROUND OF THE INVENTION

1. Field of the Invention

The present invention relates to a gate opening device and more particularly pertains to gate opening device with automatic and manual modes of operation.

2. Description of the Prior Art

The use of gate openers is known in the prior art. More specifically, gate openers are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,638,597 to Lybecker discloses a modular automatic gate opener. U.S. Pat. No. 4,416,085 to Lybecker discloses an automatic gate opener. U.S. Design Pat. No. 348,075 to Meyer discloses a gate operator design. U.S. Pat. No. 4,231,190 to Tieben discloses remotely controlled gate opener. U.S. Pat. No. 3,988,860 to Nevarez discloses an electric swinging gate assembly. U.S. Pat. No. 4,330,958 to Richmond discloses a gate opening and closing assembly with an automatic locking means.

In this respect, the automatic gate opening device of the present invention substantially departs from the conventional concepts and designs of the prior art, and in so doing provides an apparatus primarily developed for the purpose of enabling gate operation in either a manual or automatic mode.

Therefore, it can be appreciated that there exists a continuing need for improved gate opening devices. In this regard, the present invention substantially fulfills this need.

SUMMARY OF THE INVENTION

In view of the foregoing disadvantages inherent in the known types of gate openers now present in the prior art, the present invention provides a automatic gate opening device which can be retro fitted onto an exiting gate. As such, the general purpose of the present invention, which will be described subsequently in greater detail, is to permit gate operation through either automatic remote control or manual control.

To attain this, the present invention essentially comprises a gate closing device which operates either in an automatic mode or a manual mode. The device includes a first track which is adapted to be secured to a gate, and a second track to which a driving motor is interconnected. A linkage is slidably interconnected to both of these tracks. Activation of the motor results in the movement of the linkage, and thus the opening or closing of the gate. A damping device is employed at the first end of the linkage. The damping device enables the gate to be opened a slight distance without activating the motor.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gate opening device which can be operated both by remote control and manually. The gate has a closed orientation and an opened orientation. Additionally, the gate having a proximal end, a distal end,a front face and a rear face. The proximal end is pivotally connected to a post. A first length of track is secured to the rear face of the gate, and the first length of track has a distal end and a proximal end. A forward post is secured adjacent the front face of the gate at the proximal end, a return spring is interconnecting the forward post and the front face of the gate. A second track runs perpendicular to the gate in the closed orientation, with the second track having a proximal end adjacent to the proximal ends of the gate and first track. A driving linkage is included which has a length, a first end slidably interconnected within the length of the first track, and a second end slidably interconnected within the length of the second track. A dash pot is positioned at the first end of the driving linkage, with the dash pot having an internally located spring, and the dash pot functioning to allow the gate to be pivoted a distance without movement of the entire driving linkage. A continuous length of drive chain is interconnected to the second end of the driving linkage. Additionally, a motor is included for driving the continuous length of drive chain in either of two directions, a sensor is included for detecting signals and activating the motor, and a remote control is included for use in selectively sending signals to the sensor.

It is another object of the present invention to provide a dash pot device for use in conjunction with an automatic gate opening device.

It is a further object of the present invention to provide a gate opening device which can be operated at a distance via a remote control.

An even further object of the present invention is to provide a gate opening device which is susceptible of a low cost of manufacture with regard to both materials and labor, and which accordingly is then susceptible of low prices of sale to the consuming public, thereby making such gate opening devices economically available to the buying public.

Still yet another object of the present invention is to provide a gate opening device which provides in the apparatuses and methods of the prior art some of the advantages thereof, while simultaneously overcoming some of the disadvantages normally associated therewith.

Still another object of the present invention is to enable a gate to be opened via one of two modes of operation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a view of the first end of the driving linkage and the associated dash pot.

FIG. 4 is a view of the second end of the driving linkage.

FIG. 5 is a view taken along line 5—5 of FIG. 3.

FIG. 6 is a plan view of the gate device.

Similar reference characters refer to similar parts throughout the several views of the drawings.

DESCRIPTION OF THE PREFERRED EMBODIMENT

The present invention relates to a gate closing device which operates either in an automatic mode or a manual mode. The device includes a first track which is adapted to be secured to a gate, and a second track to which a driving motor is interconnected. A linkage is slidably interconnected to both of these tracks. Activation of the motor results in the movement of the linkage, and thus the opening or closing of the gate. A damping device is employed at the first end of the linkage. The damping device enables the gate to be opened a slight distance without activating the motor. The various components of the present invention, and the manner in which they interrelate, will be described in greater detail hereinafter.

Figure 8:
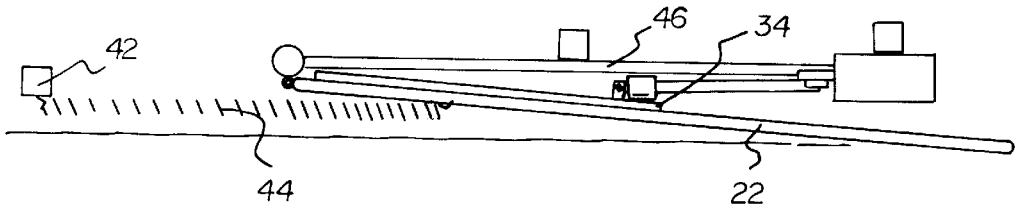
FIG. 8 is a plan view of the gate fully opened.

The gate 22 of the present invention has both an opened configuration (FIG. 8) and a closed configuration (FIG. 6). Additionally, the gate 22 is defined by a proximal end 24, a distal end 26, a front face 28 and a rear face 32. The proximal end 24 of the gate 22 is pivotally connected to a post which is secured within the ground. A first length of track 34 is secured to the rear face 32 of the gate 22. This first length of track 34 is defined by a distal end 36 and a proximal end 38.

Figure 1:
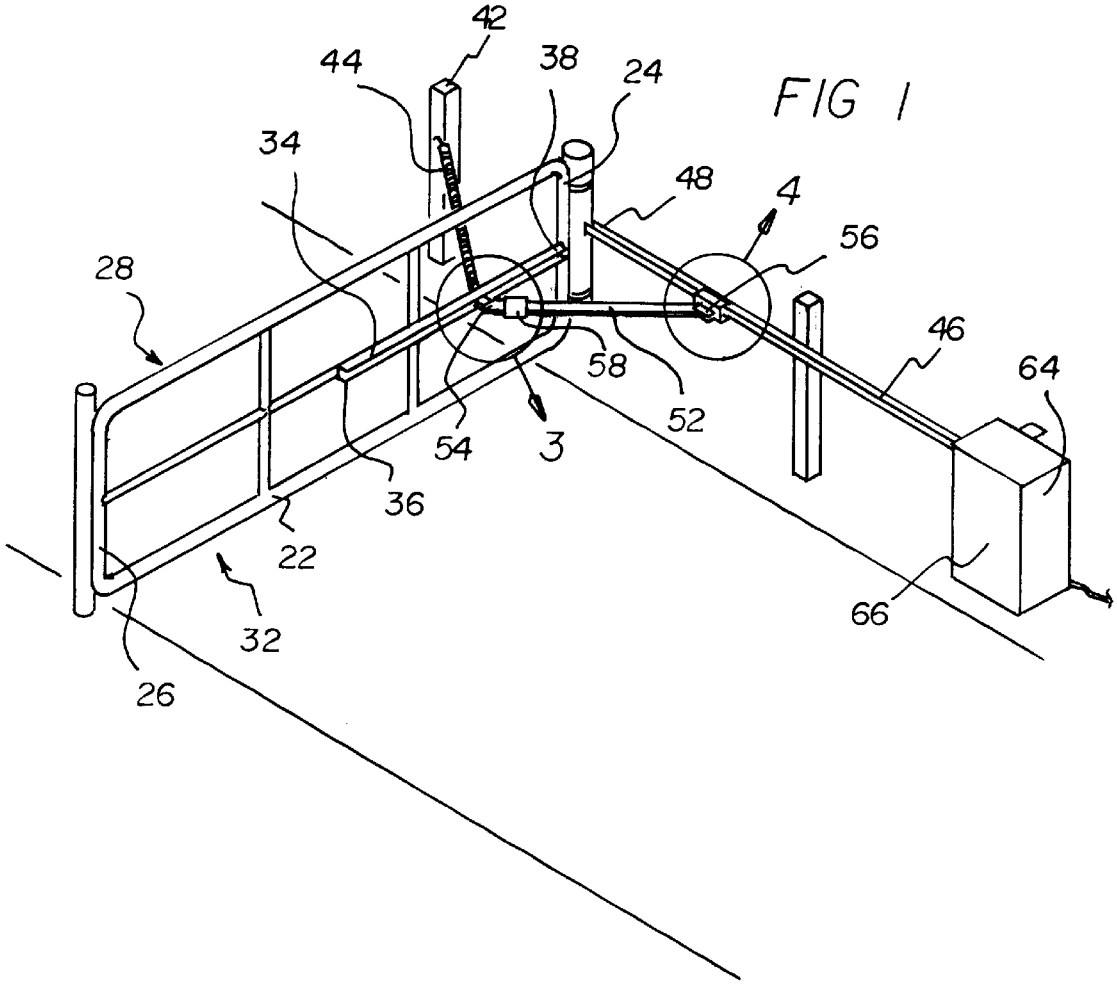
FIG. 1 is a perspective illustrate of the entire device.

With reference to FIG. 1, a forward post 42 is secured adjacent the front face 28 of the gate 22 at the gate's proximal end 24. This post 42 is secured or otherwise fixed relative to the gate 22. A return spring 44 is interconnected between the forward post 42 and the front face 28 of the gate 22. This return spring 44 functions to bring the gate 22 to its closed orientation in the absence of other forces acting upon the gate 22. A second track 46 runs perpendicular to the gate 22 in the gate's closed orientation. This length of track 46 can be positioned by one or more posts. The second track 46 is defined by a proximal end 48 which is adjacent to the proximal ends 24 and 38 of both the gate 22 and first track 34.

The first and second tracks (34 and 46 respectively)are interconnected by way of a driving linkage 52. The driving linkage 52 is defined by a length, and first 54 and second ends 56. The first end 54 of the linkage 52 is slidably interconnected within the length of the first track 34. Likewise, the second end 56 is slidably interconnected within the length of the second track 46. In this manner both the first and second ends of the linkage move relative to their associated track. The sliding motion, however, also serves to either close or open the gate 22. Thus, to open the gate 22, the chain moves to bring the second end 56 of the linkage 52 toward the distal end of the second track 46. As this occurs, the first end 54 of the linkage 52 slides toward the proximal end 38 of the first track 34. The movement of the linkage 34, however, also works to pivot the gate 22 to its opened configuration. The closing of the gate 22 is achieved in an opposite manner.

A dash pot 58 is positioned at the first end 54 of the driving linkage 52. The dash pot 58 is illustrated with reference to FIG. 5. As illustrated, the dash pot 58 includes two housing members telescopically interrelated by way of an internally located spring. The dash pot 58 functions to allow the gate 22 to be pivoted a distance without movement of the entire driving linkage 52. More specifically, the gate 22 can be manually pushed opened small distance, a distance which will be primarily absorbed by the dash pot 58. Thus, through the use of the dash pot 58 the gate 22 can be manually opened without the need to activate the motor 64 which drives the linkage 52. This is the manual mode of operation.

The automatic, or powered, mode of operation involves a chain drive 62. The drive employs a continuous length of drive chain 62 which is interconnected to the second end 56 of the driving linkage 52. Thus, rotation of the drive chain 62 moves the second end 56 of the linkage 52 along the length of the second track 46.

Figure 2:
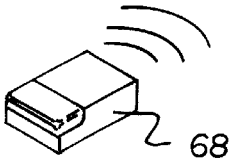
FIG. 2 is an illustration of the remote control.
Figure 7:
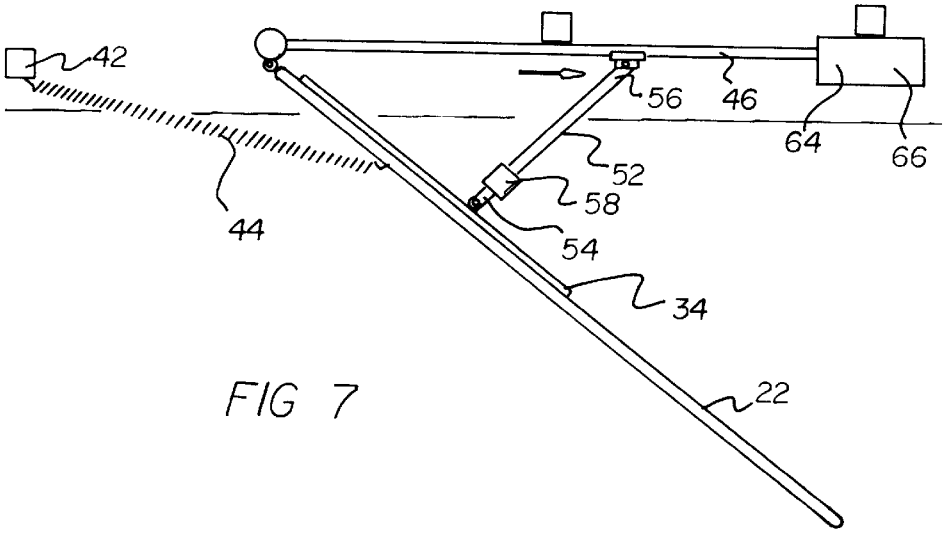
FIG. 7 is a plan view of the gate as it is being opened.

A motor 64 is employed for driving the continuous length of drive chain 62. The motor 64 is such that the chain 62 can be driven in either of two directions. A first sense for opening the gate 22, and a second sense for closing the gate 22. The motor 64 is positioned within a housing located at the end of the second track 46. The housing also includes a sensor 66 which is employed in detecting signals. The signals are employed to either activate or deactivate the motor 64 from a remote location. Additionally also incorporates a remote control 68 for use in selectively sending signals to the sensor 66 from a remote location. The remote control 68 is illustrated with reference to FIG. 2.

The above described device is specifically adapted to be retrofitted onto an existing gate. Thus, all the major components of the present invention are adapted to be secured to an existing gate.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gate closing device which can be operated both by remote control and manually, a gate having a closed orientation and an opened orientation:

the gate having a proximal end, a distal end, a front face and a rear face, the proximal end being pivotally connected to a post;

a first length of track secured to the rear face of the gate, the first length of track having a distal end and a proximal end;

a forward post secured adjacent the front face of the gate at the proximal end, a return spring interconnecting the forward post and the front face of the gate;

a second track running perpendicular to the gate in the closed orientation, the second track having a proximal end adjacent to the proximal ends of the gate and first track;

a driving linkage having a length, a first end slidably interconnected within the length of the first track, and a second end slidably interconnected within the length of the second track;

a dash pot positioned at the first end of the driving linkage, the dash pot having an internally located spring, the dash pot functioning to allow the gate to be pivoted a distance without movement of the entire driving linkage;

a continuous length of drive chain interconnected to the second end of the driving linkage;

a motor for driving the continuous length of drive chain in either of two directions, a sensor for detecting signals and activating the motor, a remote control for use in selectively sending signals to the sensor.

2. A gate closing device which can be operated both by remote control and manually, a gate having a closed orientation and an opened orientation:

the gate having a proximal end, a distal end, a front face and a rear face, the proximal end being pivtoally connected to a post;

a first length of track secured to the rear face of the gate, the first length of track having a distal end and a proximal end;

a second track running perpendicular to the gate in the closed orientation, the second track having a proximal end adjacent to the proximal ends of the gate and first track;

a driving linkage having a length, a first end slidably interconnected within the length of the first track, and a second end slidably interconnected within the length of the second track;

a continuous length of drive chain interconnected to the second end of the driving linkage;

a motor for driving the continuous length of drive chain in either of two directions.

3. The gate closing device as described in claim 2 further comprising:

a dash pot positioned at the first end of the driving linkage, the dash pot having an internally located spring, the dash pot functioning to allow the gate to be pivoted a distance without movement of the entire driving linkage.

4. The gate closing device as described in claim 2 further comprising:

a sensor for detecting signals and activating, a remote control for use in selectively sending signals to the sensor.

5. The gate closing device as described in claim 2 further comprising:

a forward post secured adjacent the front face of the gate at the proximal end, a return spring interconnecting the forward post and the front face of the gate.

* * * * *